United States Patent [19]

Ceron

[11] 4,284,118

[45] Aug. 18, 1981

[54] FOLDING-DOOR COMPRISED OF WOODEN SLATS AND HINGES

[76] Inventor: Sergio Ceron, Via Pompeo Cambiasi, 14/1 Milan, Italy

[21] Appl. No.: 66,762

[22] Filed: Aug. 14, 1979

[30] Foreign Application Priority Data

Sep. 6, 1978 [IT] Italy ..... 27350 A/78
Jun. 14, 1979 [IT] Italy ..... 21842 B/79

[51] Int. Cl.[3] ..... E06B 3/94; E06B 9/00; E05D 1/06

[52] U.S. Cl. ..... 160/229 R; 160/183; 16/171

[58] Field of Search ..... 160/229 R, 183; 16/141, 16/144, 145, 149, 159, 171, 175, 178

[56] References Cited

U.S. PATENT DOCUMENTS

| | | | |
|---|---|---|---|
| 1,092,236 | 4/1914 | Wrikeman | 16/149 |
| 2,677,420 | 5/1954 | Kuyper | 160/183 |
| 2,829,397 | 4/1958 | Nagy | 160/229 R |
| 2,834,410 | 5/1958 | Kuyper | 160/183 |
| 2,939,169 | 6/1960 | Anderson | 16/159 |
| 3,116,782 | 1/1964 | Rudnick | 160/229 R |
| 3,277,950 | 10/1966 | Stoffer | 160/183 |
| 3,423,786 | 1/1969 | Arias, Jr. et al. | 16/149 |
| 4,222,428 | 9/1980 | Scherer | 160/231 R |

*Primary Examiner*—C. J. Husar
*Assistant Examiner*—Mark A. Daugherty
*Attorney, Agent, or Firm*—Holman & Stern

[57] ABSTRACT

A folding door, of the kind composed by an array of wooden slats connected by intermediate hinge elements; the intermediate hinge elements are of wood, preferably of the same color and grain of the wood the slats are made of, and a metallic hinge element is hidden within the strips of wood interposed between any two wooden slats so that the external appearance is that of an all-wooden assembly both when the door is outstretched and when it is folded.

5 Claims, 7 Drawing Figures

FOLDING-DOOR COMPRISED OF WOODEN SLATS AND HINGES

BRIEF SUMMARY OF THE INVENTION

This invention relates to a folding door composed of wooden slats, which has the advantageous feature of being fitted with connecting joints which are also wooden, rather than the usual joints made of a plastics material.

At present wooden-slat folding doors (which may have central glass insets) provide, for the interconnection of the slats, more or less intricate hinges of a plastics material which, usually, spoil the continuity of the aesthetic appearance of the door.

There is no doubt that the best course would be to use wooden hinges, but the attempts made heretofore in that direction have the defect that they provide for very intricate connecting systems, or hinges, which are difficult both to manufacture and to install.

An object of the present invention is thus to provide a wooden-slat folding door which includes very simple wooden hinges, which are both efficient and pleasant to the sight. According to the invention, this object is achieved by means of a folding door which is characterized in that the interconnecting hinges of adjoining wooden slats are comprised of vertical wooden strips having a constant cross-sectional configuration, and through which are passed and latched at least two superposed articulation members, each of which is comprised of at least three sequentially arranged mutually hingedly connected portions, the central one of these being inserted and latched in the strip body and the side portions being inserted and latched in the corresponding ends of the two slats to be conjoined, the strips having a cross-sectional shape substantially in the shape of a double mushroom profile with opposite headers of different widths separated by intermediate side grooves and said slat ends having a cross-sectional shape substantially in the shape of a U with a longer overhanging web intended to be received in a corresponding one of said side grooves of the adjoining strip when the door is outstretched and for being positioned alongside the narrower header of the same strip substantially to conceal the groove when the door is folded and a shorter overhanging web intended for providing the visual continuity between said slat and said narrower header of the strip when the door is outstretched, the side edges of said narrower strip header acting like rotational rotulae for adjoining slats in cooperation with the central recesses of said U-shaped ends of said slats.

It is thus apparent that a prominent importance is to be attributed, in the folding door according to this invention, to the shapes of the hinge strips and the corresponding ends of the slats to be conjoined. These shapes, in actual practice, make possible not only a correct and complete motion of rotation of the slats from the folded door position to the outstretched door position, and vice versa, but also enable the two strip headers to conceal the recesses of the slat ends when the door is outstretched and enable the two shorter and longer webs of the slat ends to conceal, in their turn, to a greater or smaller degree, the side grooves of the strips and their own U-outline, in the outstretched door position and in the folded door position, respectively.

On the other hand, the importance of the hinge elements which provide the connection proper and the hinged union of the wooden slats with wooden hinges inserted therebetween should not be underrated.

Their outstanding advantage, obviously, resides in the fact that the various component parts become wholly concealed by the wooden portions which incorporate them, so as to provide an impression that the entire junction is made only of wood: obviously the wood of the junction portions will be made of a wood matching the grain and colour of the wood used for the slats.

BRIEF DESCRIPTION OF THE SEVERAL VIEWS OF THE DRAWING

In order that the features and advantages of the invention may be better understood, a preferred embodiment of the invention will now be described in detail, by way of nonlimiting example, reference being had to the accompanying drawings, wherein.

DETAILED DESCRIPTION

Figure 2:
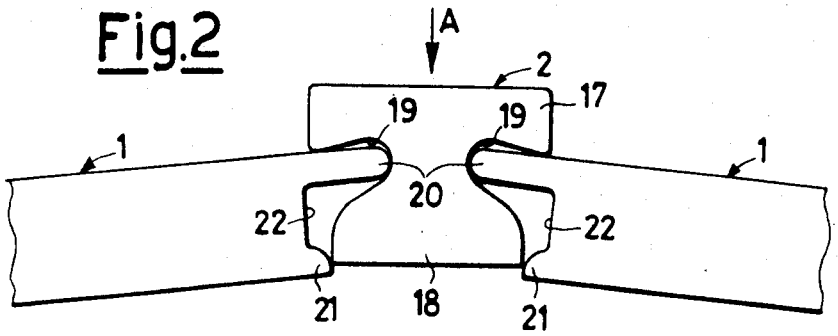
FIG. 2 is a top plan view of one of the hinged joints between adjoining slats.
Figure 1:
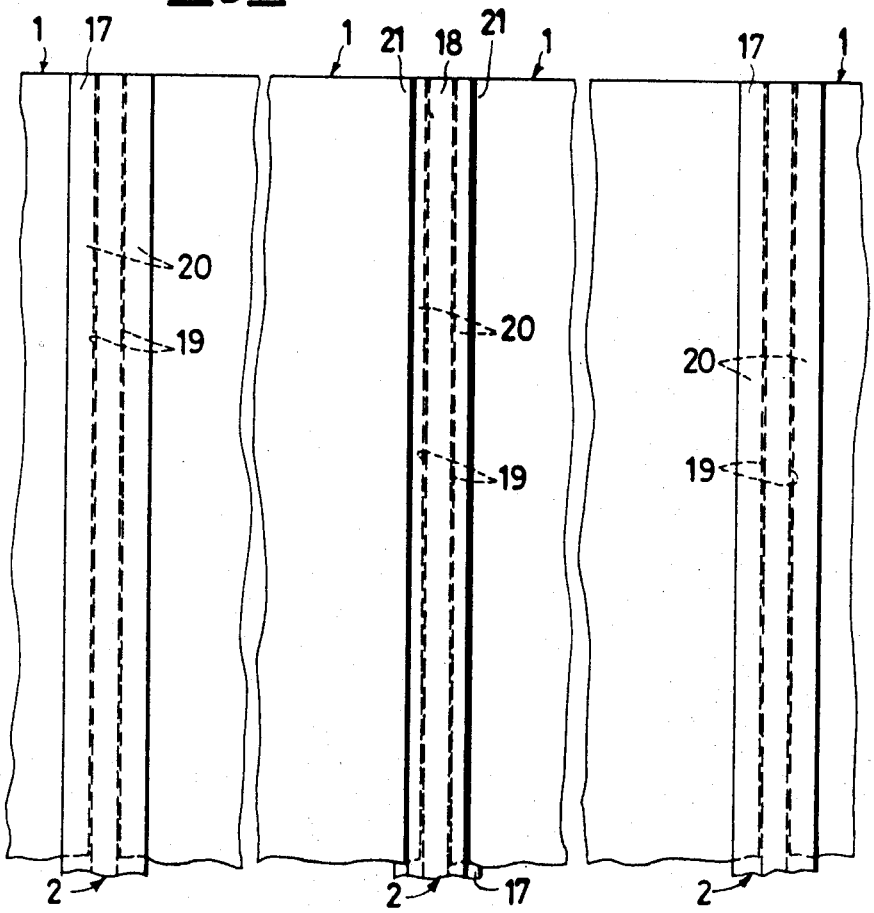
FIG. 1 is a diagrammatical front elevation, in the outstretched position, of a portion of a folding door made according to the present invention.
Figure 4:
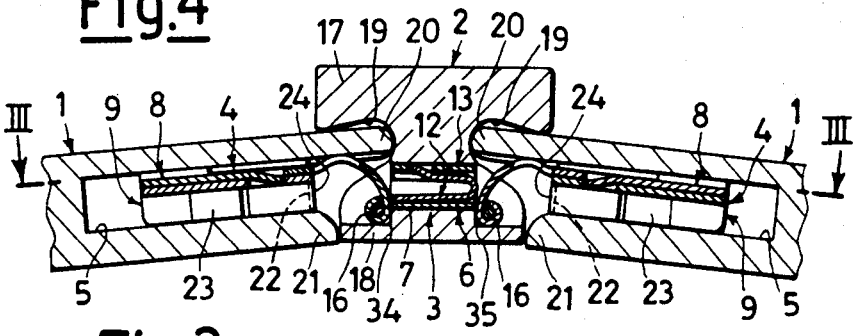
FIG. 4 shows the hinge joint in cross-sectional view taken along the line IV—IV of FIG. 3.
Figure 3:
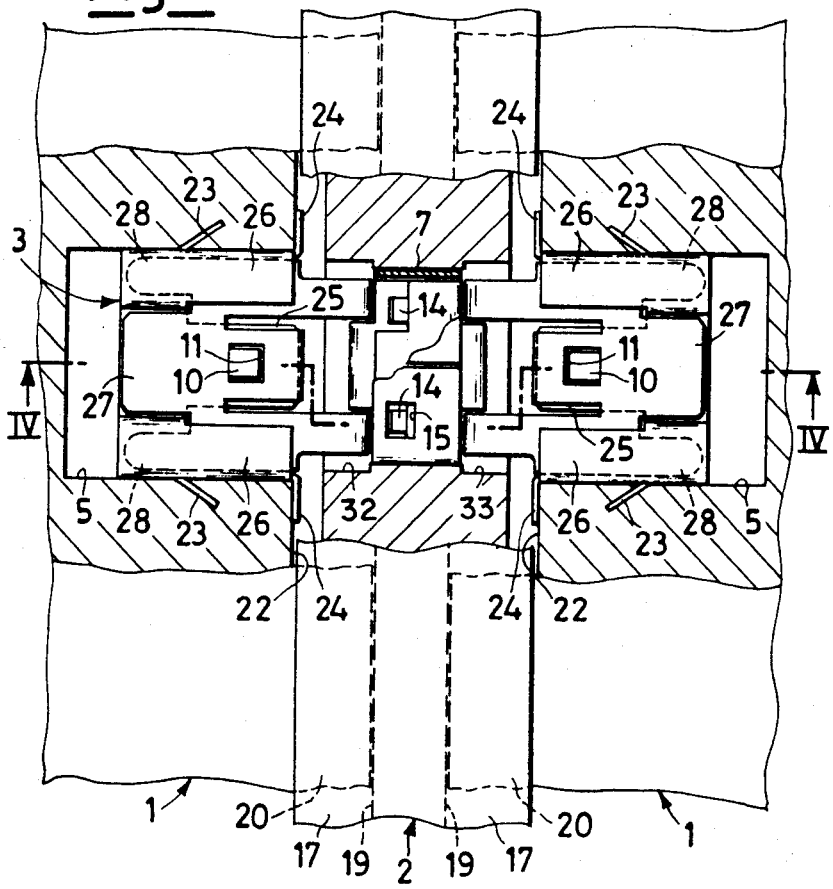
FIG. 3 shows that hinge joint, in part as viewed along the direction of the arrow A of FIG. 2, and in part in cross-sectional view taken along the line III—III of FIG. 4.
Figure 5:
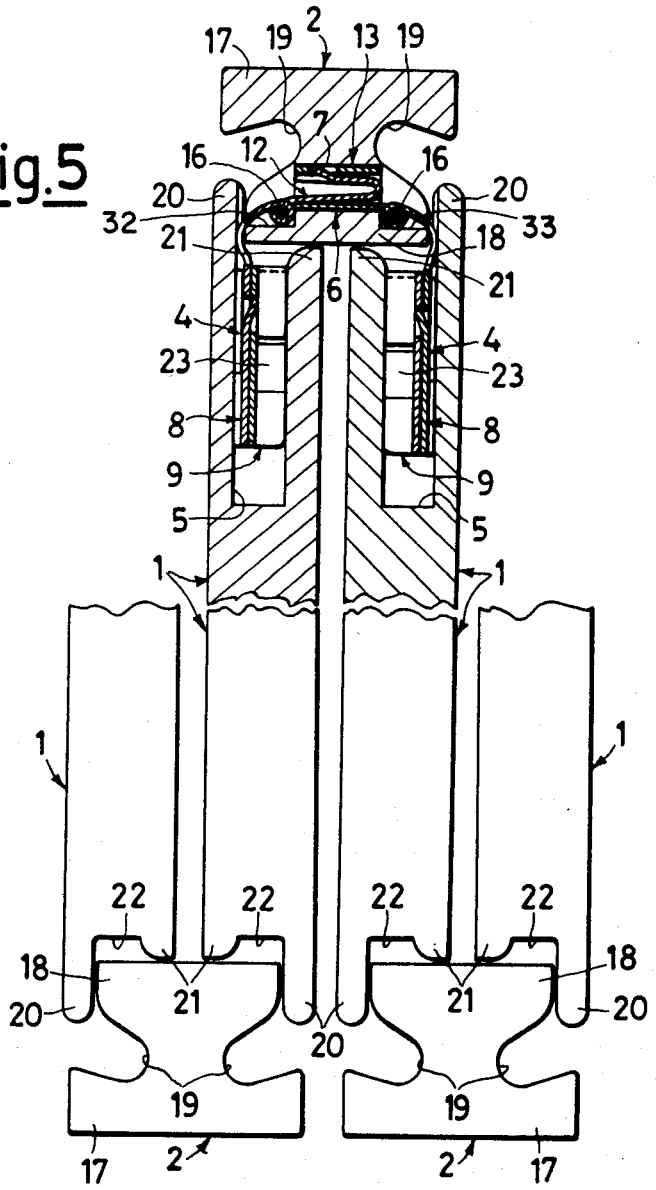
FIG. 5 shows the same folding-door section in the folded condition, in part as viewed in top plan view, and in part in cross-sectional view as in FIG. 4.

The folding door shown in FIGS. 1 to 5 inclusive is comprised of an array of wooden slats 1, connected to each other hingedly by wooden joints 2 made in the form of vertical strips having a constant cross-sectional shape (FIGS. 1, 2 and 5).

With every one of said strips and the corresponding ends of the adjoining slats cooperate two or more metallic hinge pieces 3, arranged at different levels relative to the strip axis, and each piece is formed by two side portions 4 inserted in appropriate seats 5 of the ends of the slats 1, and by a central portion 6 located in a bore 7 of the strip 2.

Figure 7:
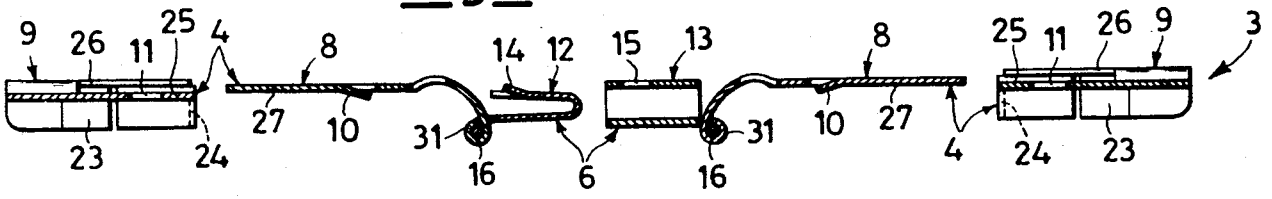
FIG. 7 shows the hinge element in lengthwise cross-sectional view taken along the line VII—VII of FIG. 6.
Figure 6:
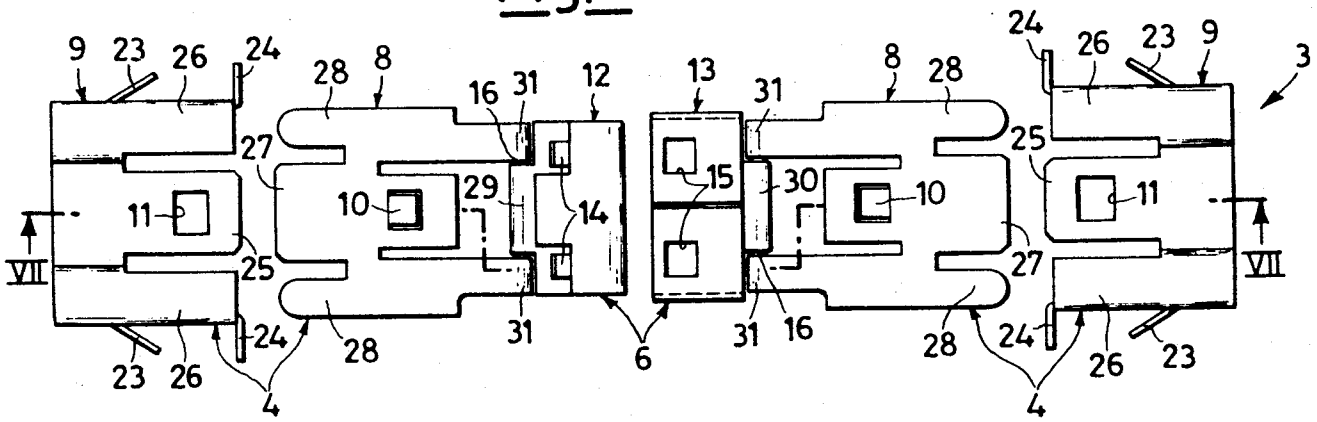
FIG. 6 is an elevational view, which is an exploded view, of one of the hinge elements according to the invention, which are a part of the folding door shown in the previous Figures of the drawings.

As best seen in FIGS. 6 and 7, each of the two side portions 4 is formed by two discrete pieces 8 and 9, and likewise the central portion 6 is formed by two discrete pieces 12 and 13.

Each piece 9 is completely and forcibly inserted into its respective seat 5 of the slat 1 (FIGS. 3–5), wherein it is latched by means of jutting side wings 23 and 24, and has a recessed central portion 25 and two raised side portions 26, above and, respectively, below which there are inserted corresponding coplanar portions 27 and 28 of the adjoining piece 8. The central portion 27 of the latter piece 8 has a jutting wing 10 which is inserted into a corresponding window 11 of the central portion 25 of the piece 9 for the mutual snapping hookup of the pieces 8 and 9. The piece 12 of the central portion 6, in its turn, is inserted in the interior of the piece 13 and is snappingly hooked there to by the engagement of wings 14 of the former into windows 15 of the latter.

Lastly, the two pieces 12 and 13 of the central portion 6 are hinged to the adjoining pieces 8 of the side portions 4 by means of pins 16 inserted in coaxial ears 29 and 30 of the pieces 12 and 13, and ears 31 of the pieces 8.

These ears are housed in widened chambers 32 and 33 of the strip 2 and abut respective fixed shoulders 34 and 35 placed at the two inlets of the bore 7.

As shown in FIGS. 2,4 and 5, each strip 2 has a cross-sectional outline substantially in the shape of a double mushroom with opposite headers 17 and 18 of different width and intermediate side grooves 19. The corresponding ends of the slats 1 have, in their turn, a cross-sectional outline substantially in the shape of a U, with a longer web 20 and a shorter web 21 having an intermediate recess 22 therebetween.

When the door is outstretched as shown in FIGS. 1–4, the longer webs 20 of the nearside ends of the two adjoining slats 1 are inserted in the side recesses 19 of the interposed strip 2, and thus are concealed by the wider header 17 of the strip, whereas the shorter webs 21 cooperate with the narrower header 18 of the strip so as to provide, on the opposite side, a visual continuity which conceals the hollowed-out portions of the strip 2 and of the ends of the slats 1 (FIGS. 2 and 4). As the door is folded as in FIG. 5, the longer webs 20 of the strip ends are arranged, conversely, alongside the narrower header 18 of the strip and conceal to a predominant extent the shape of the latter so displaying to the eyes of an observer substantially a planar rib which is aesthecally pleasing and is actually the winder header 17 of the strip 2. In no case, do any of the hinge metallic members 3 becomes exposed and visible.

In the production of the assembled doors, once the wooden portions have been prepared, that is, the slats 1 with their seats 5 and the shaped strips 2 with their bores 7, the pieces 9 of the hinge members 3 are inserted into the seats 5 aforesaid so that the assembly can be shipped to dealers or directly to the customers.

For the erection of the folded door assembly, it is only necessary to snappingly latch the pieces 8 of the hinge elements 3 to the pieces 9 and, finally, to insert from opposite directions the pieces 12 and 13 (hinged to the pieces 8) into the bores 7 of the strips 2 and snappingly to unite them together.

I claim:

1. A folding door of the type wherein an array of wooden slats are hingedly connected together at adjacent vertical edges, comprising vertical wooden hinge strips each having a horizontal cross-sectional shape substantially in the form of a double mushroom with a central stem and oppositely disposed heads of different widths separated by side recesses, at least two longitudinally spaced apertures through said stem, said adjacent vertical edges of said slats having a horizontal cross-sectional shape in the form a U with legs of different lengths to thereby form a longitudinal slot in each said vertical edge, hinges for connecting said slats together each having a central part and oppositely disposed side parts hingedly connected to said central part, said central part being disposed and latched within one of said apertures in said strip, and said side parts being inserted and latched in said adjacent vertical edges of said slats, said strips, slats and hinges being assembled together so that when the door is in the unfolded position, the longer legs of said slat edges are received in the adjacent side recesses of said strip and the shorter legs of said slat edges each lie closely adjacent the narrower head of said mushroom shaped strip so as to appear to be a continuation thereof, and when the door is in the folded position, said longer legs are disposed alongside the adjacent said narrower head to substantially conceal said side recesses, said slates rotating substantially about the vertical side edges of said narrower head.

2. A folding door as claimed in claim 1, wherein said central part of each said hinge is made in two pieces which are inserted from opposite directions through one of said apertures of said strip and have means for snappingly latching them together.

3. A folding door as claimed in claim 2, wherein said side parts of each said hinge are made in two pieces with means for snappingly latching them together, and further comprising cut out seats provided in said vertical edges of said slats, a first piece of each of said side parts being entirely inserted and latched in one of said seats and a second piece of each of said side parts being hingedly connected to a corresponding one of said pieces of said central part.

4. A folding door as claimed in claim 3, wherein said means for latching said two pieces of said central part together and said means for latching said two pieces of said side parts together comprise a projecting wing on one piece and a window on the other piece arranged so that when assembled said projecting wing snappingly engages within said window.

5. A folding door as claimed in claim 3, wherein said second piece of each said side part has at least three coplanar laterally adjoining portions, and said first piece of each said side part has a corresponding number of laterally adjoining portions in alternating displaced planes to form at least one slot, so that when assembled said portions of said second piece engage in said slot of said first piece.

* * * * *